US007823869B2

(12) United States Patent
Ise

(10) Patent No.: US 7,823,869 B2
(45) Date of Patent: Nov. 2, 2010

(54) SHEET FEEDER, IMAGE FORMING APPARATUS HAVING THE SAME, AND METHOD FOR SHEET FEEDING

(75) Inventor: Tokihiko Ise, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/330,018

(22) Filed: Dec. 8, 2008

(65) Prior Publication Data

US 2009/0146367 A1 Jun. 11, 2009

Related U.S. Application Data

(60) Provisional application No. 61/012,768, filed on Dec. 10, 2007.

(51) Int. Cl.
*B65H 3/44* (2006.01)
*B65H 5/26* (2006.01)

(52) U.S. Cl. ..... 271/9.03; 271/9.12; 271/157; 271/158; 271/164

(58) Field of Classification Search ..... 271/9.03, 271/9.12, 157, 158, 164
See application file for complete search history.

(56) References Cited

U.S. PATENT DOCUMENTS 5,102,112 A * 4/1992 Takahashi ..... 271/9.08
5,195,734 A * 3/1993 Tanabe ..... 271/9.03
5,335,903 A * 8/1994 Martin et al. ..... 271/157
5,971,387 A * 10/1999 Kita ..... 271/9.03
6,123,329 A * 9/2000 Sato et al. ..... 271/9.01
6,332,609 B1 * 12/2001 Arakawa ..... 271/157
6,371,474 B1 * 4/2002 Amano ..... 271/3.02
6,547,234 B1 * 4/2003 Quesnel ..... 271/9.08
7,618,037 B2 * 11/2009 Kang et al. ..... 271/157

FOREIGN PATENT DOCUMENTS

JP PH05-124737 1/1992
JP PH04-144600 5/1994
JP P2002-347956 2/2002

* cited by examiner

*Primary Examiner*—Patrick Mackey
*Assistant Examiner*—Prasad V Gokhale
(74) *Attorney, Agent, or Firm*—Patterson & Sheridan, LLP

(57) ABSTRACT

A sheet feeder includes a sheet feed tray on which a first sheet bundle is stacked at a first position where sheet feeding to a conveyance path can be performed, and a conveyance tray on which a second sheet bundle is stacked at a second position adjacent to the sheet feed tray, and which conveys the second sheet bundle to the sheet feed tray and stacks the second sheet bundle on the sheet feed tray after the first sheet bundle is fed, presses the stacked second sheet bundle to a side plate provided in a direction perpendicular to a conveyance direction of the conveyance tray, and aligns an end of the second sheet bundle.

9 Claims, 17 Drawing Sheets

SHEET FEEDER, IMAGE FORMING APPARATUS HAVING THE SAME, AND METHOD FOR SHEET FEEDING

CROSS-REFERENCE TO RELATED APPLICATIONS

This application is based upon and claims the benefit of priority from U.S. provisional application 61/012,768, filed on Dec. 10, 2007, and the entire contents of each of which are incorporated herein by reference.

TECHNICAL FIELD

The present invention relates to a sheet feeder, an image forming apparatus having the same and a method for sheet feeding, and particularly to a large capacity sheet feeder in which sheet bundles to be fed are horizontally arranged and can be stacked, an image forming apparatus having the same and a method for sheet feeding.

BACKGROUND

A certain image forming apparatus, such as a copier or an MFP (Multi-Function Peripheral), has a large capacity sheet feeder which can contain a large amount of sheets before printing. As one of such large capacity sheet feeders, there is a tandem large capacity feeder (hereinafter referred to as a tandem LCF).

The tandem LCF has two spaces in which sheet bundles can be horizontally arranged and contained. A sheet bundle stacking tray called a sheet feed tray is provided at a lower part of one of the spaces, and a sheet bundle stacking tray called a conveyance tray is provided at a lower part of the other space. A sheet bundle of, for example, about 1000 or more sheets can be stacked on each of the sheet feed tray and the sheet conveyance tray.

When a sheet is printed, the sheet is sequentially picked up one by one from the upper side of the sheet bundle stacked on the sheet feed tray. The picked up sheet is used for print processing through a conveyance path.

When a sensor detects that all sheets in the sheet bundle on the sheet feed tray are used, the conveyance tray on which a different sheet bundle is stacked is moved to the sheet feed tray side, and the conveyance tray is stopped at a position where the conveyance tray overlaps the sheet feed tray. Thereafter, the conveyance tray returns to the original position while leaving the sheet bundle stacked thereon on the sheet feed tray. As a result, the new sheet bundle is stacked on the sheet feed tray which became empty, and sheet feeding for a next print operation becomes possible.

Although the conveyance tray returned to the original position is empty, the conveyance tray is constructed to be capable of being pulled out to the outside independently of the sheet feed tray. Thus, even when sheets are being fed from the sheet feed conveyance tray.

It is desirable that ends of the sheet bundle stacked on the sheet feed tray are aligned in a longitudinal direction and a lateral direction (that is, alignment is performed in the longitudinal direction and the lateral direction). When printing is started in a state where the alignment is not performed in the longitudinal direction or the lateral direction, each sheet of the sheet bundle is picked up in such a state that the position of the sheet is shifted in the longitudinal direction or the lateral direction (or both directions), and there is a possibility that printing is performed at an unsuitable position.

In the tandem LCF of the related art, alignment in the movement direction of the conveyance tray (hereinafter, the movement direction of the conveyance tray is called a longitudinal direction, and the alignment in the longitudinal direction is called longitudinal alignment) can be relatively easily performed by pressing the sheet bundle to a side wall of the sheet feeder by the driving force of the conveyance tray.

However, alignment in a direction perpendicular to the movement direction of the conveyance tray (hereinafter, the direction perpendicular to the movement direction of the conveyance tray is called a lateral direction, and the alignment in the lateral direction is called lateral alignment) is insufficient.

SUMMARY

The present invention is made in view of the above circumstances, and it is an object to provide a sheet feeder in which both longitudinal alignment and lateral alignment can be well performed in a tandem large capacity sheet feeder, an image forming apparatus having the same and a method for sheet feeding.

In order to achieve the object, according to an aspect of the invention, a sheet feeder includes a sheet feed tray on which a first sheet bundle is stacked at a first position where sheet feeding to a conveyance path can be performed, and a conveyance tray on which a second sheet bundle is stacked at a second position adjacent to the sheet feed tray, and which conveys the second sheet bundle to the sheet feed tray and stacks the second sheet bundle on the sheet feed tray after the first sheet bundle is fed, presses the stacked second sheet bundle to a side plate provided in a direction perpendicular to a conveyance direction of the conveyance tray, and aligns an end of the second sheet bundle.

According to another aspect of the invention, an image forming apparatus includes a scanner to read an original document and to generate image data, an image forming section to print the image data on a sheet, and a sheet feeder to feed the sheet to the image forming section, in which the sheet feeder includes a sheet feed tray on which a first sheet bundle is stacked at a first position where sheet feeding to a conveyance path can be performed, and a conveyance tray on which a second sheet bundle is stacked at a second position adjacent to the sheet feed tray, and which conveys the second sheet bundle to the sheet feed tray and stacks the second sheet bundle on the sheet feed tray after the first sheet bundle is fed, presses the stacked second sheet bundle to a side plate provided in a direction perpendicular to a conveyance direction of the conveyance tray, and aligns an end of the second sheet bundle.

According to still another aspect of the invention, a method of sheet feeding includes stacking a first sheet bundle on a sheet feed tray disposed at a first position to feed a sheet to a conveyance path, stacking a second sheet bundle on a conveyance tray at a second position adjacent to the sheet feed tray, conveying the second sheet bundle to the sheet feed tray and stacking it on the sheet feed tray after the first sheet bundle is fed, and pressing the stacked second sheet bundle to a side plate provided in a direction perpendicular to a conveyance direction of the conveyance tray to align an end of the second sheet bundle.

DESCRIPTION OF THE DRAWINGS

In the accompanying drawings.

DETAILED DESCRIPTION

An embodiment of an image forming apparatus and a method of sheet feeding of the invention will be described with reference to the accompanying drawings.

(1) Structure

Figure 1:
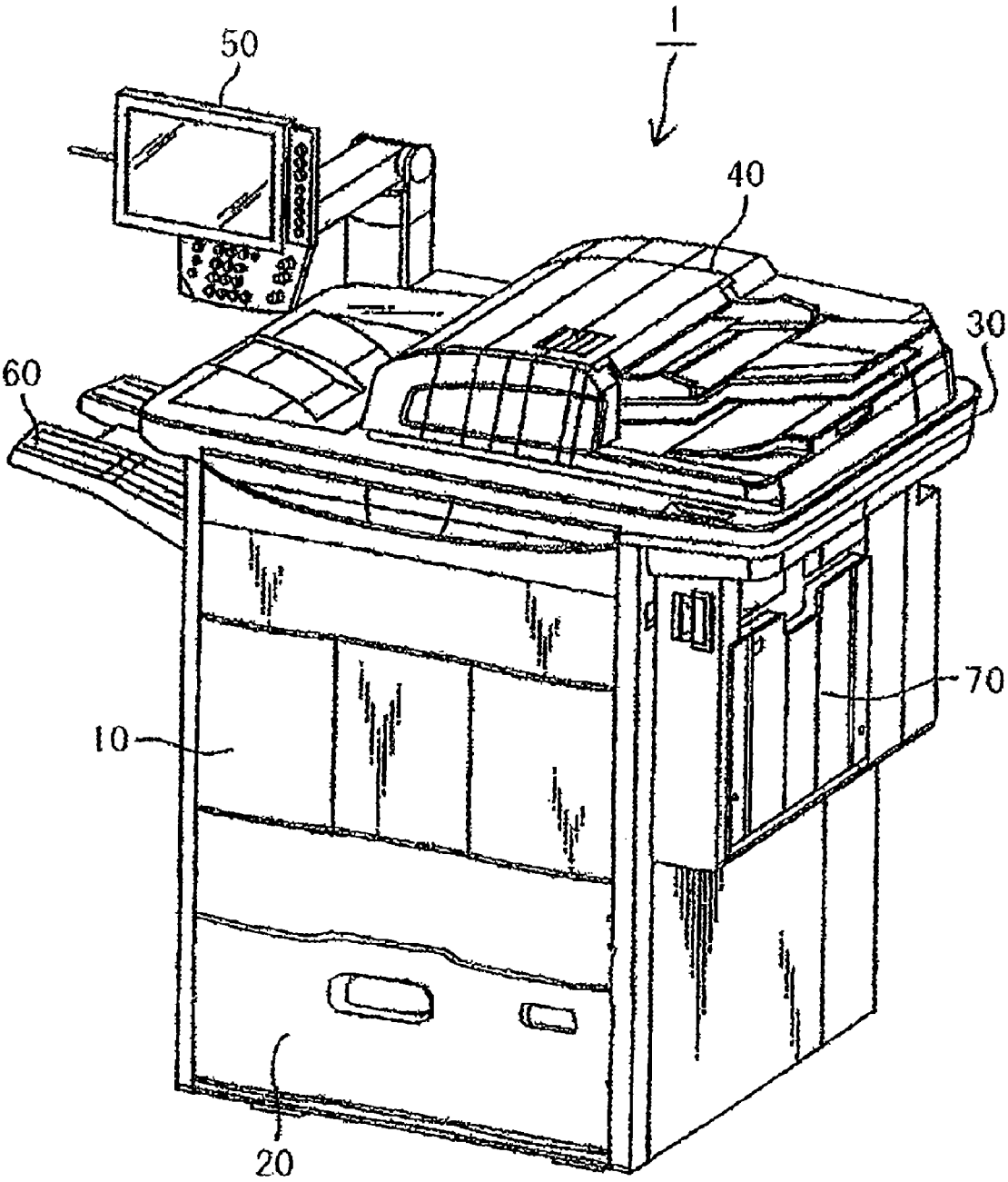
FIG. 1 is a perspective view showing an outer appearance example of an image forming apparatus of an embodiment.

FIG. 1 is a view showing an outer appearance example of an image forming apparatus 1 of the embodiment. The image forming apparatus 1 includes an image forming section 10 to print image data on a sheet, a large tandem LCF 20 to feed a sheet to the image forming section 10, a scanner 30 to read an original document, to convert it into image data and to output the image data to the image forming section 10, and an auto document feeder 40 to automatically feed an original document to the scanner 30.

Besides, the image forming apparatus 1 includes an operation display section 50 to give an instruction of printing in the image forming section 10 and an instruction of document reading in the scanner 30. Further, a sheet tray 60 for discharging a sheet printed in the image forming section 10 and a foldable manual feed tray 70 are provided on the side of the image forming apparatus 1.

The tandem LCF 20 is constructed to be capable of being pulled out in the front direction in FIG. 1.

Figure 2:
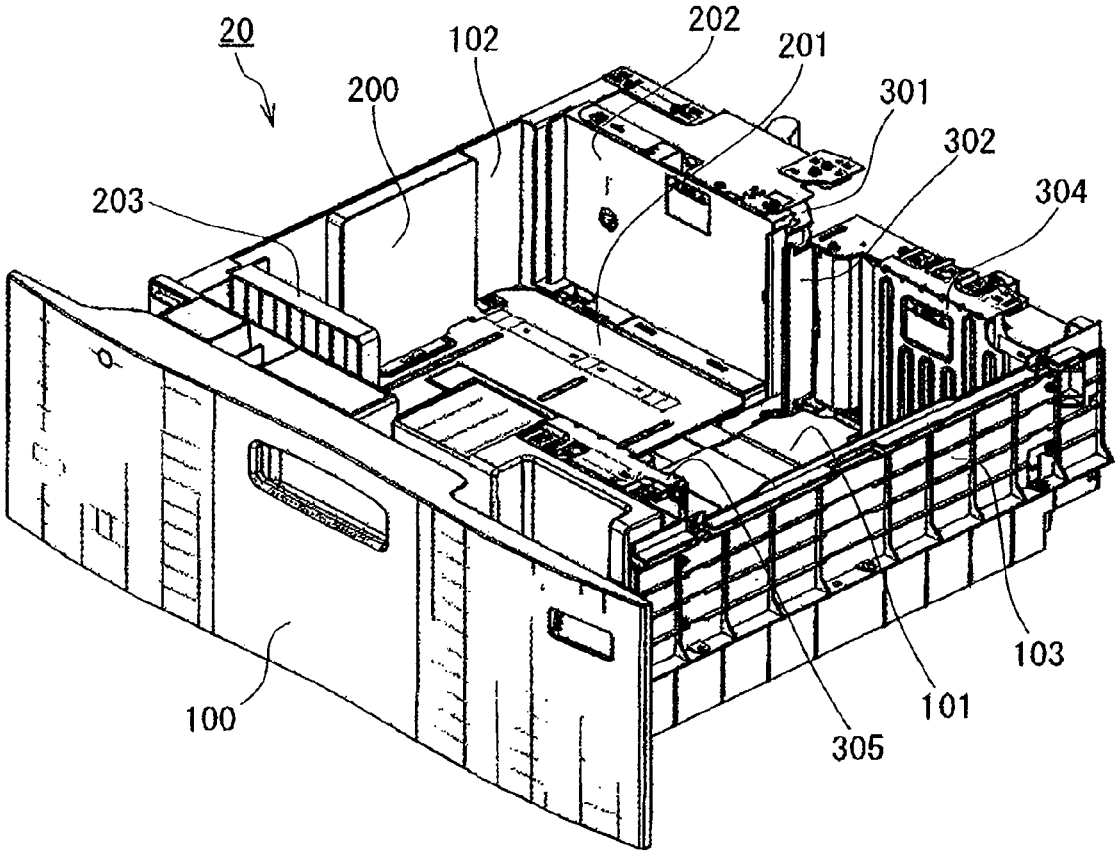
FIG. 2 is a first perspective view showing a structural example of a sheet feeder of the embodiment.
Figure 3:
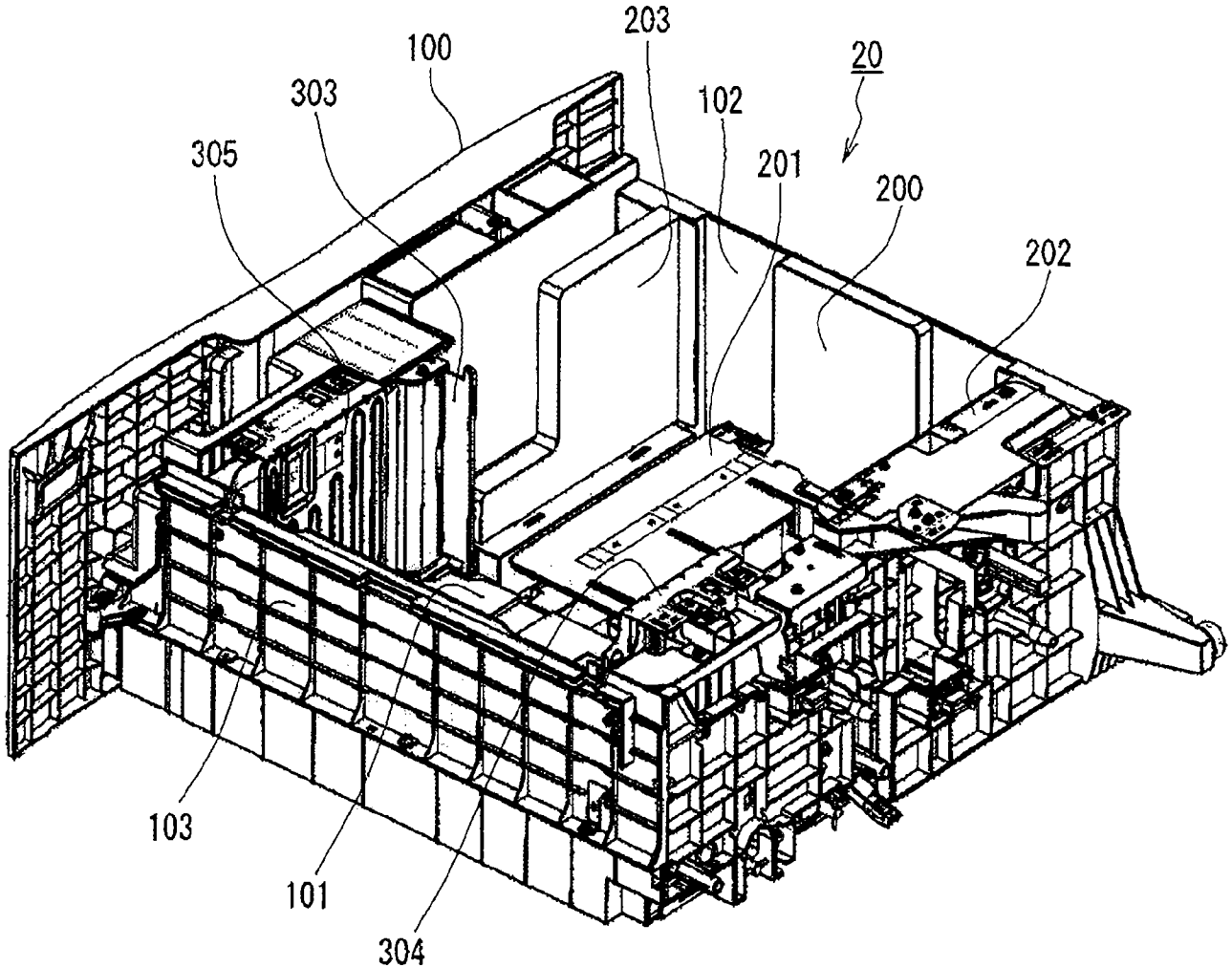
FIG. 3 is a second perspective view showing the structural example of the sheet feeder of the embodiment.
Figure 4:
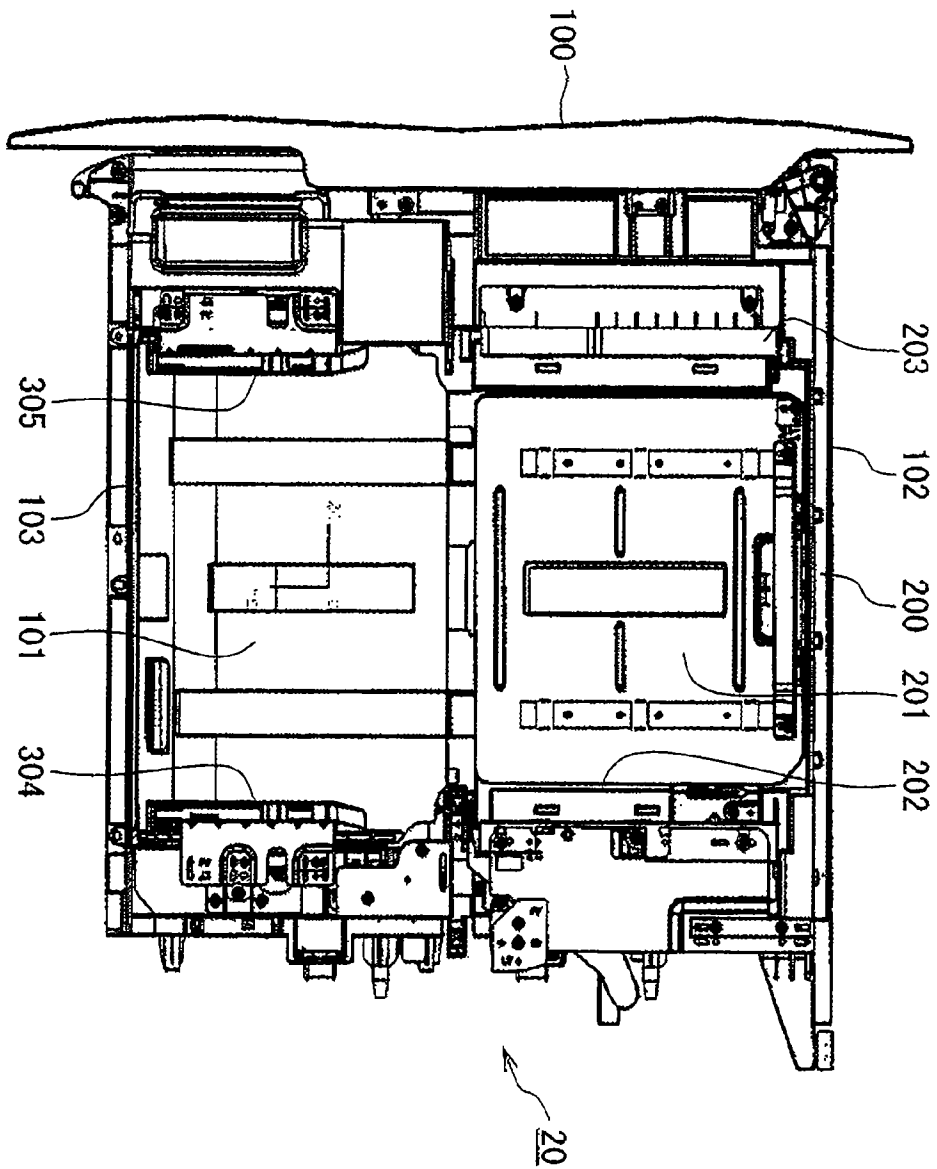
FIG. 4 is a plan view showing the structural example of the sheet feeder of the embodiment.

FIG. 2 to FIG. 4 are views showing a structure of the tandem LCF 20 in a state where the tandem LCF 20 is taken out to the outside.

The tandem LCF 20 includes a sheet containing section surrounded by front side plates 203 and 305, two side panels 102 and 103, and rear side plates 202 and 304. The sheet containing section can contain a first sheet bundle P1 and a second sheet bundle P2 arranged side by side.

The first sheet bundle P1 is stacked at the right position (first position) of the sheet containing section when viewed from the front side of a front panel 100, and the second sheet bundle P2 is stacked at the left position (second position) of the sheet containing section.

A sheet feed tray 101 on which the first sheet bundle P1 is stacked is provided at the first position and on the bottom side. The rear side plate (side plate) 304 is provided to extend upward at the rear of the sheet feed tray 101 when viewed from the front side of the front panel 100, and the front side plate (second side plate) 305 is provided to extend upward in front of the sheet feed tray 101.

On the other hand, a conveyance tray 201 on which a second sheet bundle P2 is stacked is provided at the second position and on the bottom side. The rear side plate (side plate) 202 is provided to extend upward at the rear of the conveyance tray 201 when viewed from the front side of the front panel 100, and the front side plate (second side plate) 203 is provided to extend upward in front of the conveyance tray 101.

Further, a sheet rear end guide 200 is provided to extend upward at the left of the conveyance tray 201 when viewed from the front side of the front panel 100.

Besides, thin and long stoppers 302 and 303 extending in the up-and-down direction are respectively provided at a front position and a rear position between the sheet feed tray 101 and the conveyance tray 201.

Figure 5:
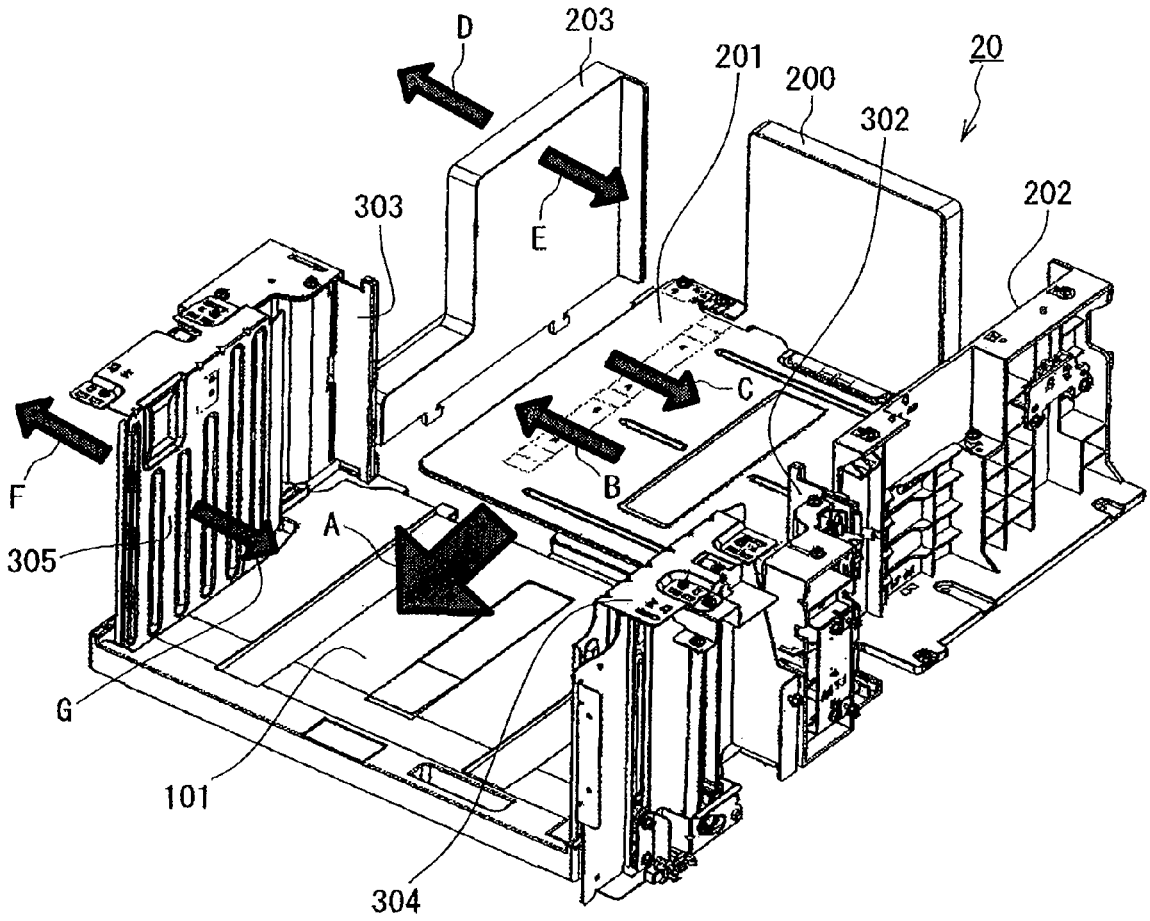
FIG. 5 is a view showing a movable section of the sheet feeder.

FIG. 5 is a view showing movable sections and their movement directions with arrows in the tandem LCF 20.

An arrow A indicates a conveyance direction of the second sheet bundle P2 by the conveyance tray 201. As stated above, the first sheet bundle P1 is stacked on the sheet feed tray 101, and the second sheet bundle P2 is stacked on the conveyance tray 201.

A sheet is fed to the image forming section 10 from the first sheet bundle P1 stacked on the sheet feed tray 101. When all sheets in the first sheet bundle P1 on the sheet feed tray 101 are fed, the conveyance tray 201 on which the second sheet bundle P2 is stacked is moved in the arrow A direction from the second position, overlaps the sheet feed tray 101 at the first position and is stopped. At this time, the sheet rear end guide 200, together with the conveyance tray 201, is moved in the arrow a direction, and presses the end of the second sheet bundle P2 in the conveyance direction (that is, the longitudinal direction) to the side panel 103 (see FIG. 2 to FIG. 4, the illustration thereof is omitted in FIG. 5). By this pressing, the longitudinal alignment of the second sheet bundle is performed.

Thereafter, the conveyance tray 201 moves in a direction opposite to the arrow A while leaving the second sheet bundle P2 on the sheet feed tray 101, and returns to the second position in an empty state.

An arrow B to an arrow G indicate movements relating to lateral alignment of the second sheet bundle P2. The lateral alignment may be performed when the conveyance tray 201 is at the second position, or may be performed at the position (first position) where it overlaps the sheet feed tray 101.

When the lateral alignment is performed while the conveyance tray 201 is at the second position, the conveyance tray 201 moves the second sheet bundle P2 in the direction perpendicular to the conveyance direction (that is, in the lateral direction). For example, the second sheet bundle P2 is moved in an arrow C direction, and the end of the second sheet bundle P2 in the lateral direction is pressed to the rear side plate 202. Further, the front side plate 203 may be moved in an arrow E direction to press the end of the second sheet bundle P2 at the opposite side in the lateral direction. By these pressing operations, the lateral alignment of the second sheet bundle P2 is performed. Thereafter, the conveyance tray 201 and the front side plate 203 move in an arrow B direction and an arrow D direction and return to the original positions.

On the other hand, when the conveyance tray 201 performs the lateral alignment at the first position, after the conveyance tray 201 moves to the first position (that is, after the conveyance tray 201 overlaps the sheet feed tray 101), the second sheet bundle P2 is moved in the arrow C direction, and the end of the second sheet bundle P2 in the lateral direction is pressed to the rear side plate 304. Further, the front side plate 305 may be moved in an arrow G direction to press the end of the second sheet bundle P2 at the opposite side in the lateral direction. Also by these pressing operations, the lateral alignment of the second sheet bundle P2 is performed. Thereafter, the conveyance tray 201 moves in the arrow B direction and returns to the original position, and similarly, the front side plate 305 moves in an arrow F direction and returns to the original position.

In FIG. 5, the arrows indicate the movements of the conveyance tray 201 and the front side plates 203 or 305 when the rear side end of the second sheet bundle P2 in the lateral direction is pressed to the rear side plate 202 or 304 and the lateral alignment is performed. However, conversely, the lateral alignment may be performed in such a manner that the conveyance tray 201 and the rear side plate 202 or 304 press the front side end of the second sheet bundle P2 to the front side plate 203 or 305.

(2) Operation

FIG. 6 to FIG. 29 are views for explaining a series of movements of the first and the second sheet bundles P1 and P2 in the tandem LCF 20.

Figure 6:
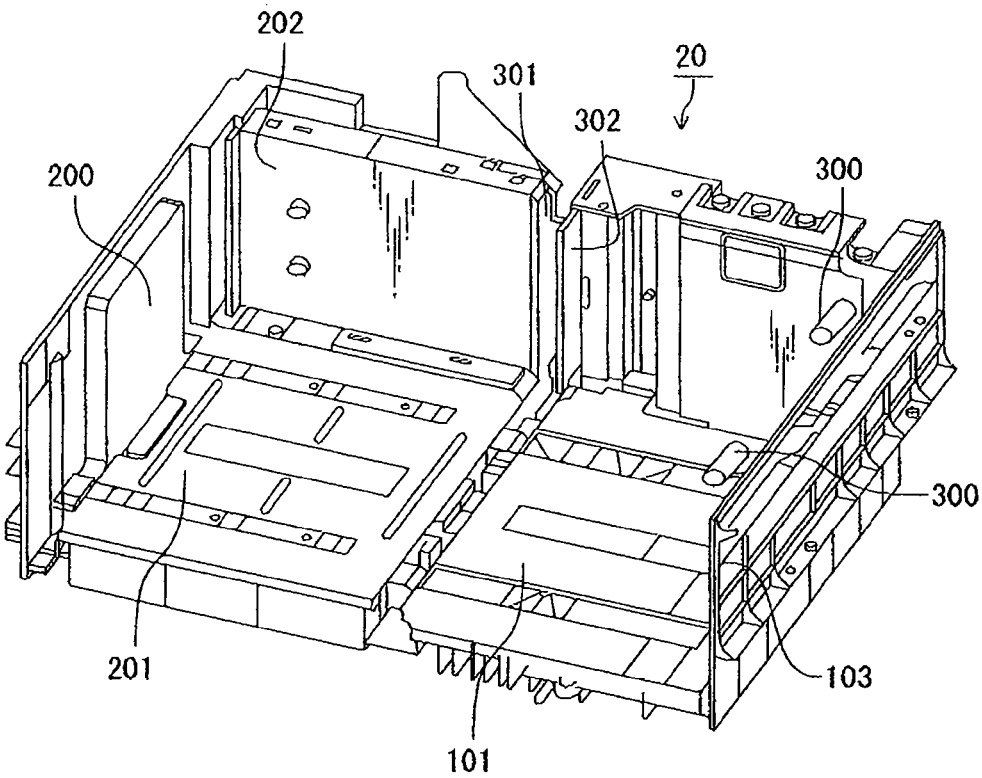
FIG. 6 and FIG. 7 are a perspective view and a plan view showing a state where a sheet bundle is not stacked in the sheet feeder, respectively.
Figure 7:
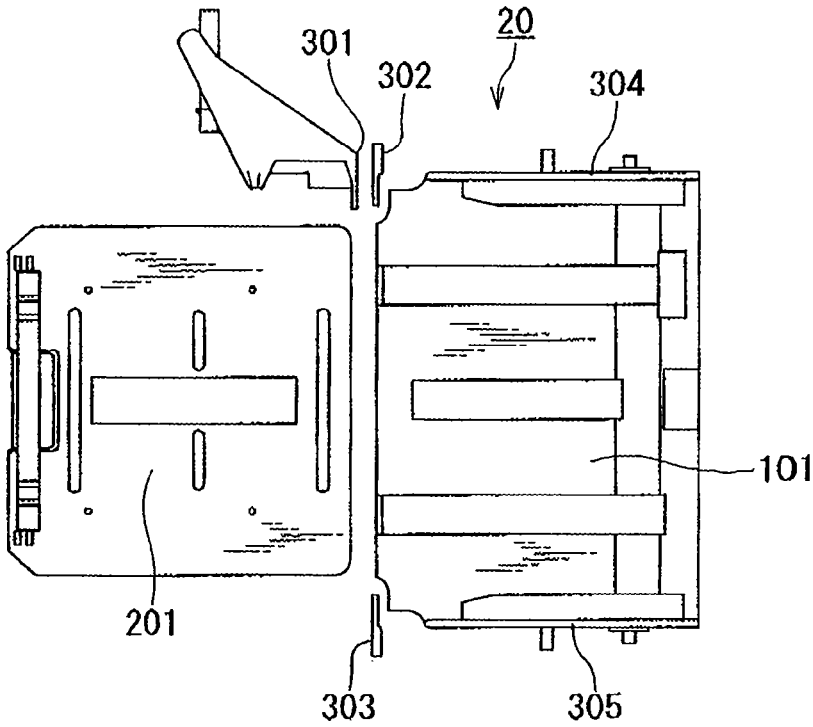

FIG. 6 is a perspective view showing the tandem LCF 20 in a state where the first and the second sheet bundles P1 and P2 are not stacked, and FIG. 7 is a plan view showing the tandem LCF 20 in a state where the first and the second sheet bundles P1 and P2 are not stacked. In FIG. 6 and FIG. 7, the structure necessary to describe the series of movements of the first and the second sheet bundles P1 and P2 is chosen and illustrated, and the illustration of the other structure is omitted.

Figure 8:
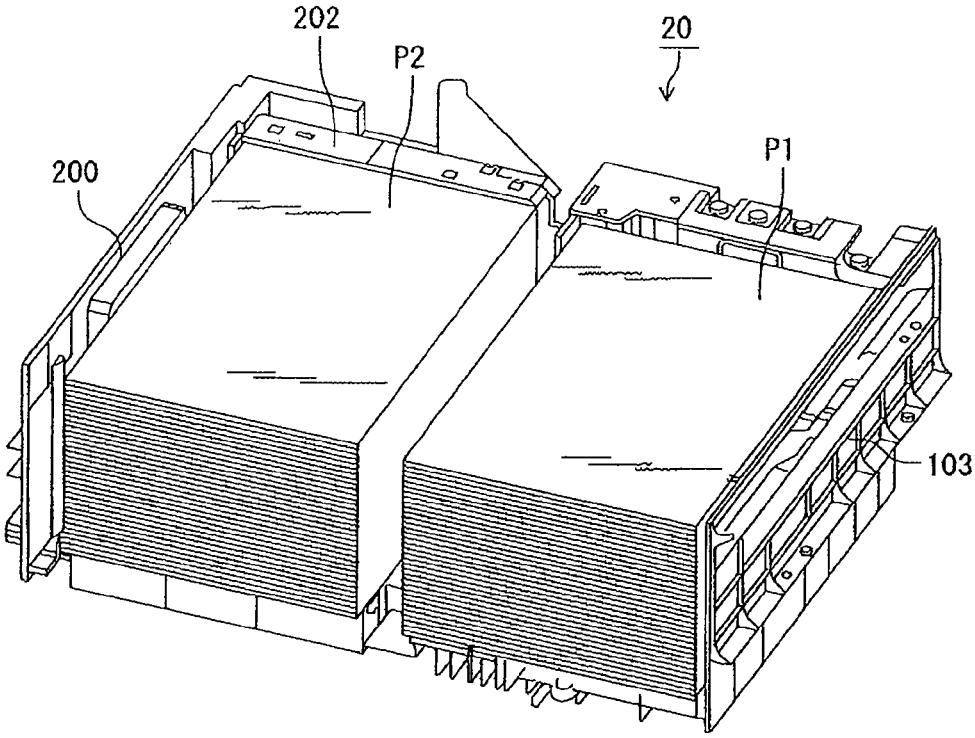
FIG. 8 and FIG. 9 are a perspective view and a plan view showing a state where a sheet bundle is stacked in the sheet feeder, respectively.

Perspective views and plan views shown in FIG. 8 and the following (except FIG. 12 to FIG. 15) are views when viewed from the same angle as the perspective view of FIG. 6 and the plan view of FIG. 7.

Figure 9:
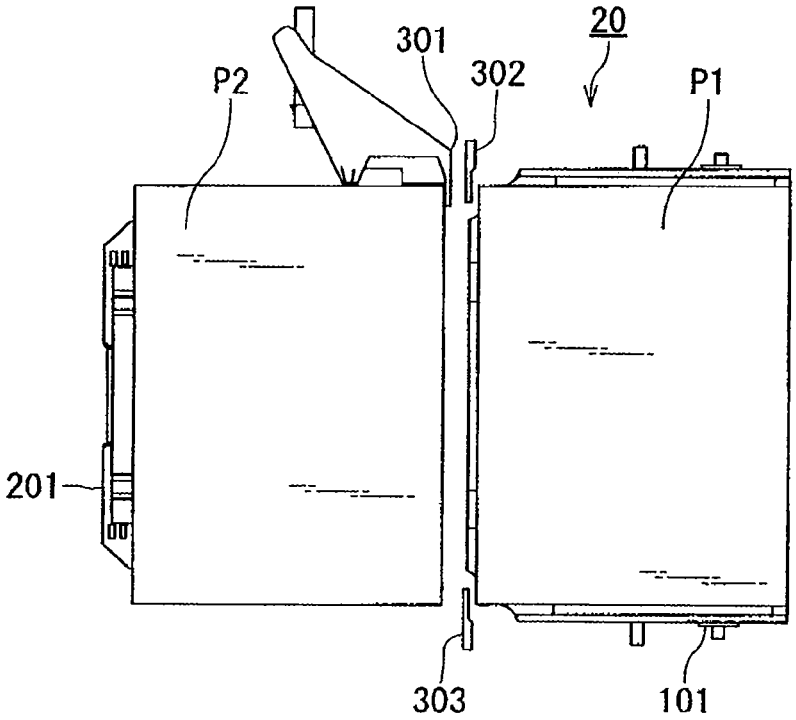

FIG. 8 and FIG. 9 are a perspective view and a plan view in a state where the tandem LCF 20 is pulled out from the image forming apparatus 1, and the first sheet bundle P1 is stacked on the sheet feed tray 101, and the second sheet bundle P2 is stacked on the conveyance tray 201.

As shown in FIG. 9, the stoppers 302 and 303 provided between the first sheet bundle P1 and the second sheet bundle P2 are at closed positions, and facilitate positioning when the user stacks the first sheet bundle P1 on the sheet feed tray 101.

Besides, as shown in FIG. 9, a guide member 301 is provided adjacent to the stopper 302, and when the tandem LCF 20 is pulled out from the image forming apparatus 1, a tip of the guide member 301 is closed. Since the tip of the guide member 301 is closed, positioning is facilitated when the user stacks the second sheet bundle P2 on the sheet feed tray 101.

Figure 10:
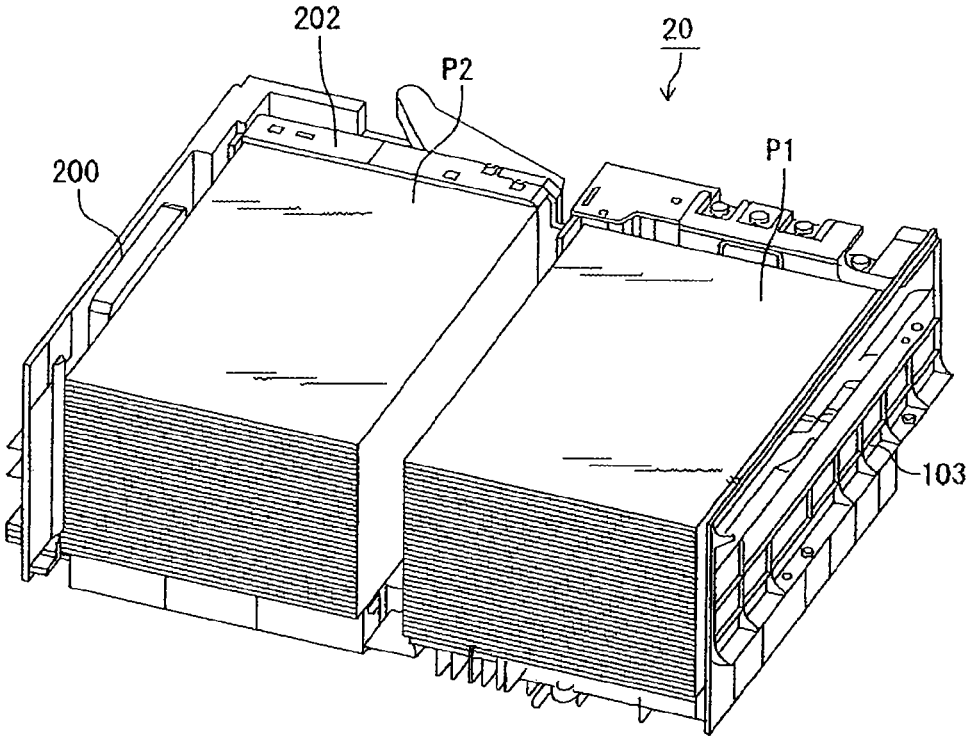
FIG. 10 and FIG. 11 are a first perspective view and a first plan view showing the movement of the sheet bundle in the sheet feeder, respectively.
Figure 11:
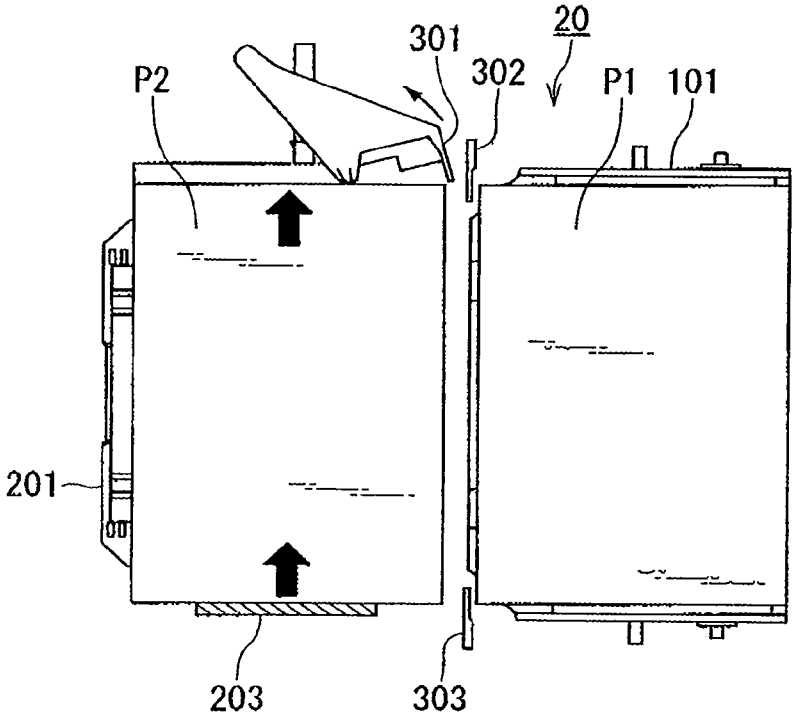
Figure 12:
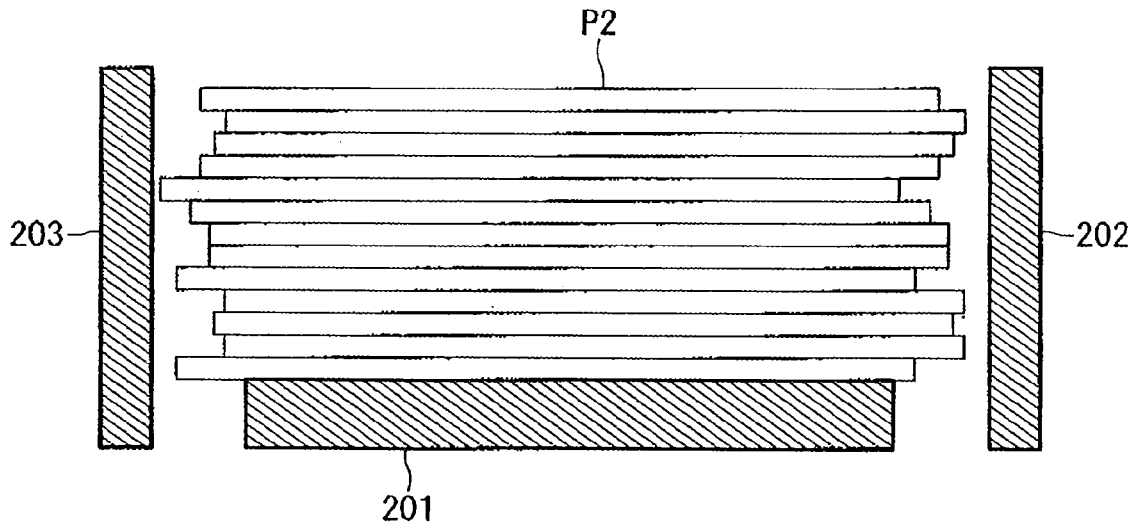
FIG. 12 to FIG. 15 are views showing movements in which lateral alignment of the sheet bundle is performed.

FIG. 10 and FIG. 11 are a perspective view and a plan view in which after the first and the second sheet bundles P1 and P2 are stacked on the sheet feed tray 101 and the conveyance tray 201, the tandem LCF 20 is pushed into the image forming apparatus 1, and then, the second sheet bundle P2 is laterally aligned at the second position.

When the tandem LCF 20 is pushed into the image forming apparatus 1, as shown in FIG. 11, the tip of the guide member 301 is opened.

Besides, the conveyance tray 201 and the front side plate 203 move the second sheet bundle P2 in an arrow direction of FIG. 10 and FIG. 11, and performs the lateral alignment of the second sheet bundle P2.

FIG. 12 to FIG. 15 are views showing a state where the second sheet bundle P2 is laterally aligned by the movement of the conveyance tray 201 and the front side plate 203 in the lateral direction.

Immediately after a user stacks the second sheet bundle P2 on the conveyance tray 201, the ends of the second sheet bundle P2 are not laterally aligned and are often irregular.

Figure 13:
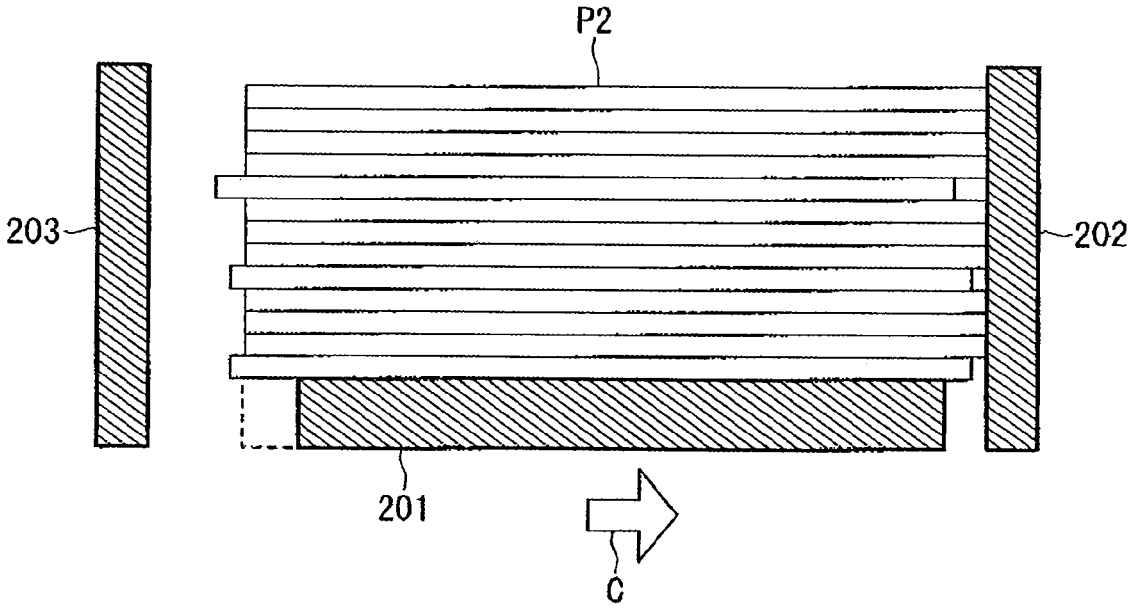

Then, when a not-shown sensor detects that the tandem LCF 20 in which the second sheet bundle P2 is stacked on the conveyance tray 201 is pushed into the image forming apparatus 1, the conveyance tray 201 moves in the arrow C direction, and presses the end of the second sheet bundle P2 in the lateral direction to the rear side plate 202 to perform the lateral alignment, as shown in FIG. 13.

Figure 14:
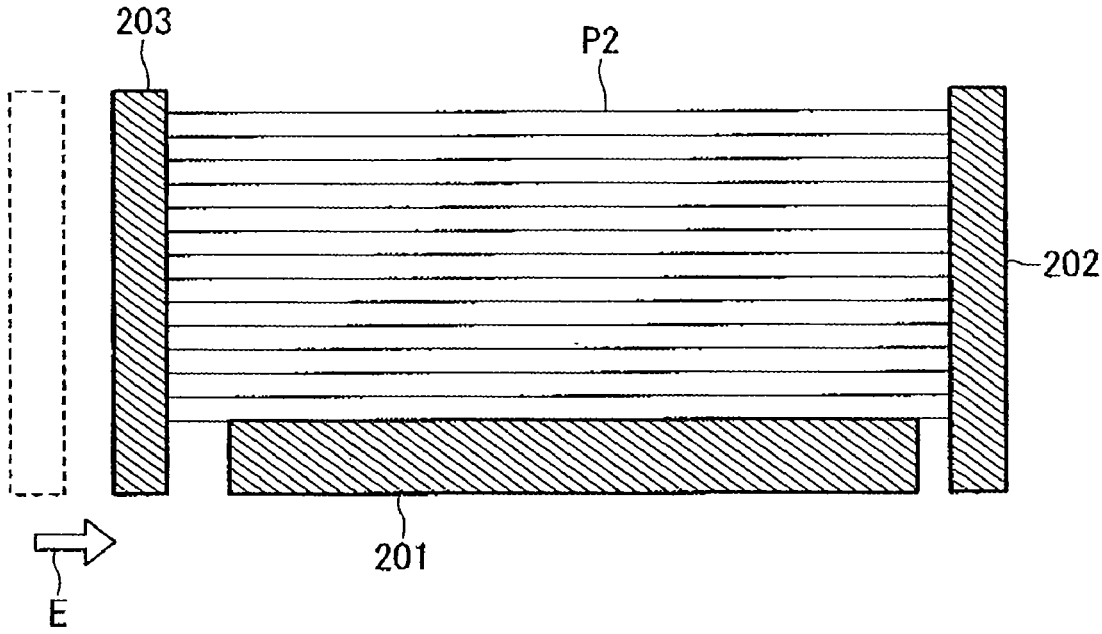

Further, as shown in FIG. 14, the front side plate 203 is moved in the arrow E direction to press the end of the second sheet bundle P2 at the opposite side in the direction toward the rear side plate 202, and the lateral alignment may be performed. Although the lateral alignment can be performed only by the pressing of the conveyance tray 201, the lateral alignment can be more certainly performed by adding the pressing of the front side plate 203.

Figure 15:
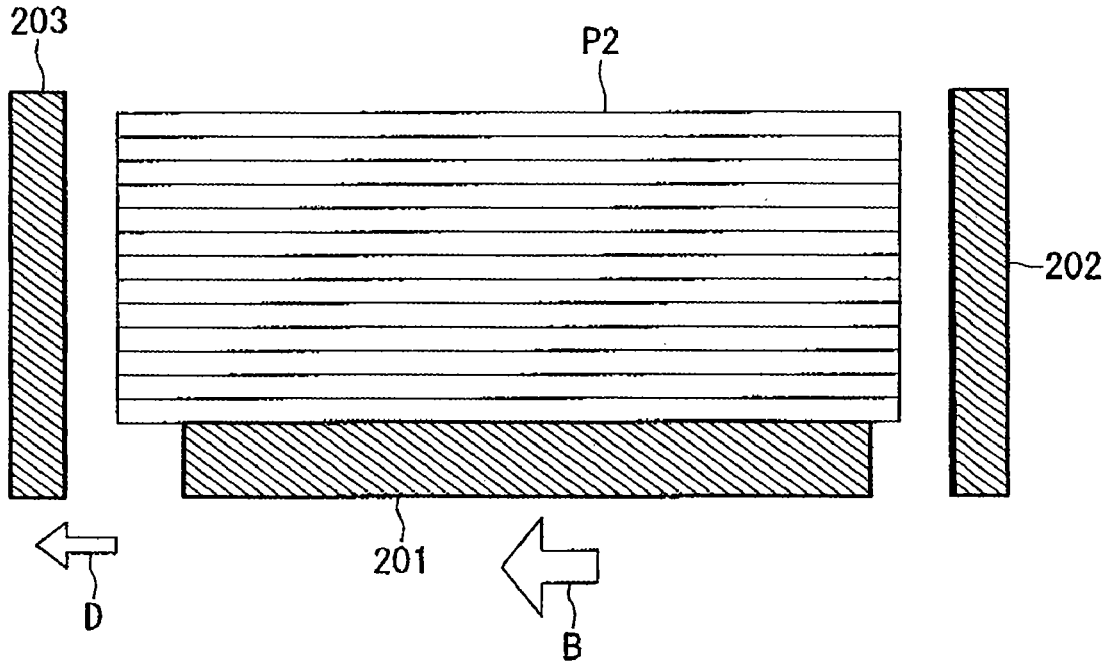

Thereafter, as shown in FIG. 15, the conveyance tray 201 and the front side plate 203 move in the directions of the arrow B and the arrow D, respectively, and return to the original positions. At this time, the second sheet bundle P2 in which the lateral alignment is completed is stacked on the conveyance tray 201.

Figure 16:
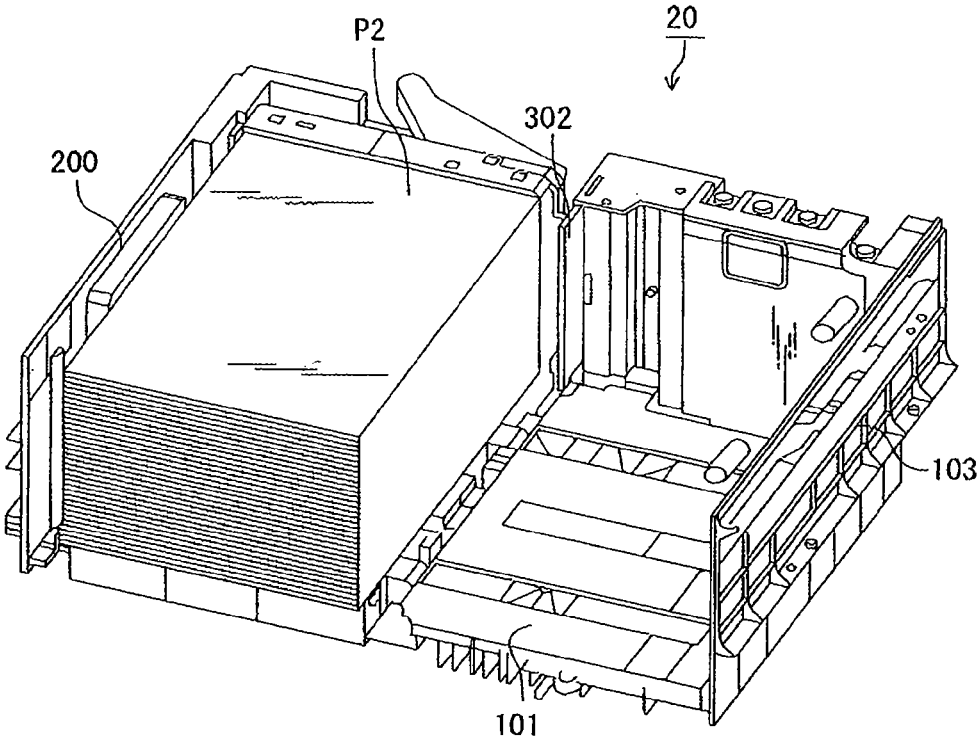
FIG. 16 and FIG. 17 are a second perspective view and a second plan view showing the movement of the sheet bundle in the sheet feeder, respectively.
Figure 17:
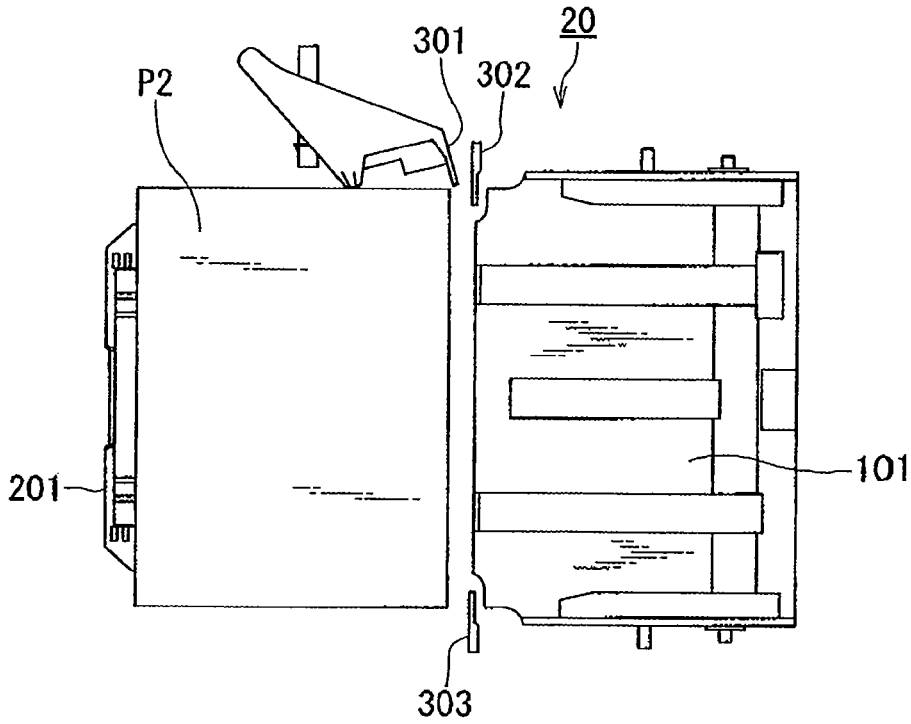

Meanwhile, sheets are sequentially fed from the first sheet bundle P1 stacked on the sheet feed tray 101 to the image forming section 10 by a pickup roller 300 (see FIG. 6), and as shown in FIG. 16 and FIG. 17, all sheets in the first sheet bundle P1 are fed to the image forming section 10 and the sheet feed tray 101 becomes empty.

Figure 18:
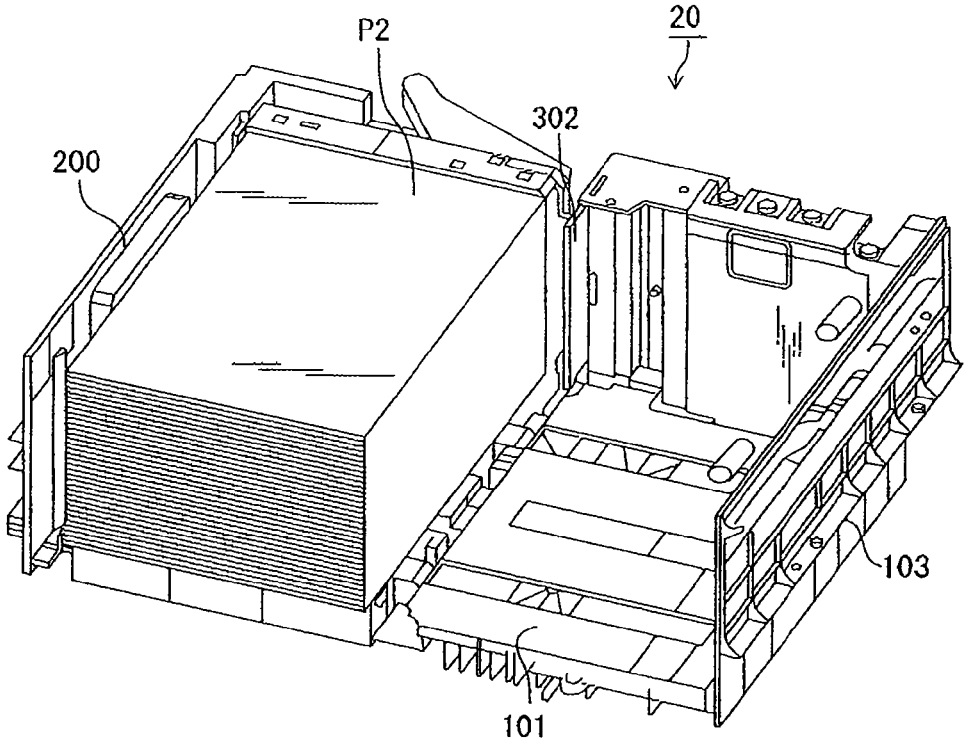
FIG. 18 and FIG. 19 are a third perspective view and a third plan view showing the movement of the sheet bundle in the sheet feeder, respectively.
Figure 19:
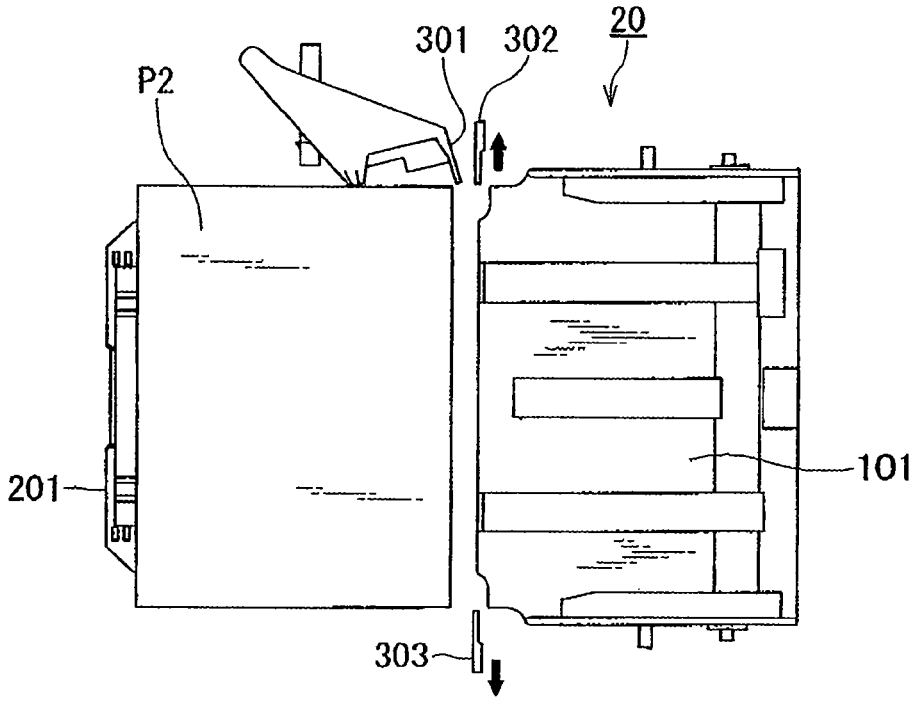

When a not-shown sensor detects that the sheet feed tray 101 becomes empty, the stoppers 302 and 303 are moved to open positions, and a path in which the second sheet bundle P2 moves to the first position is secured, as shown in FIG. 18 and FIG. 19.

Figure 20:
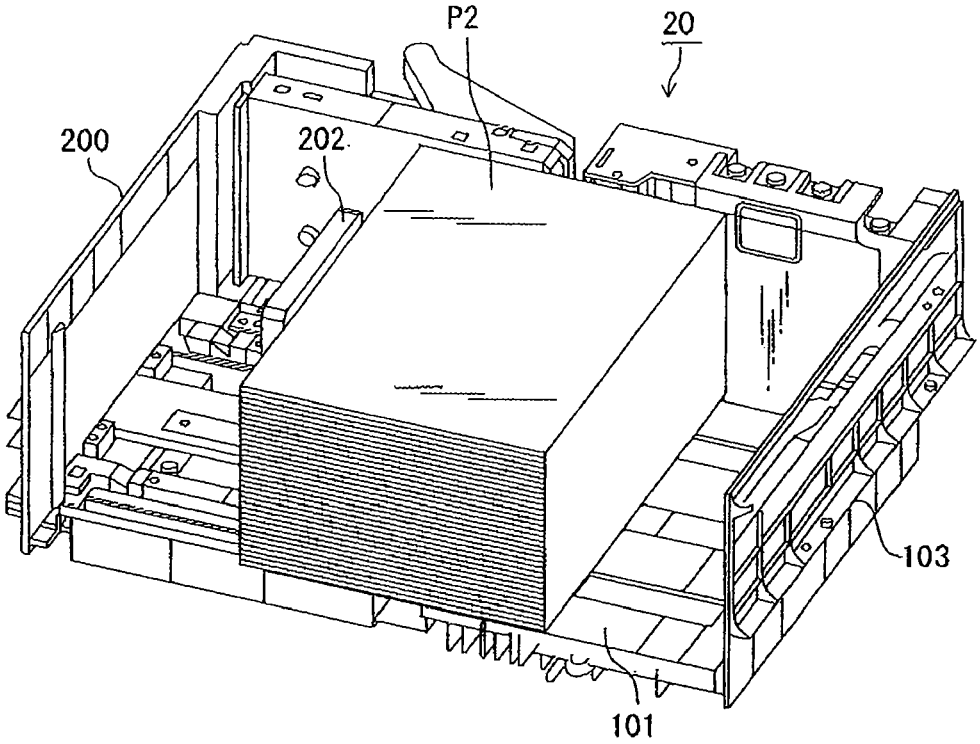
FIG. 20 and FIG. 21 are a fourth perspective view and a fourth plan view showing the movement of the sheet bundle in the sheet feeder, respectively.
Figure 21:
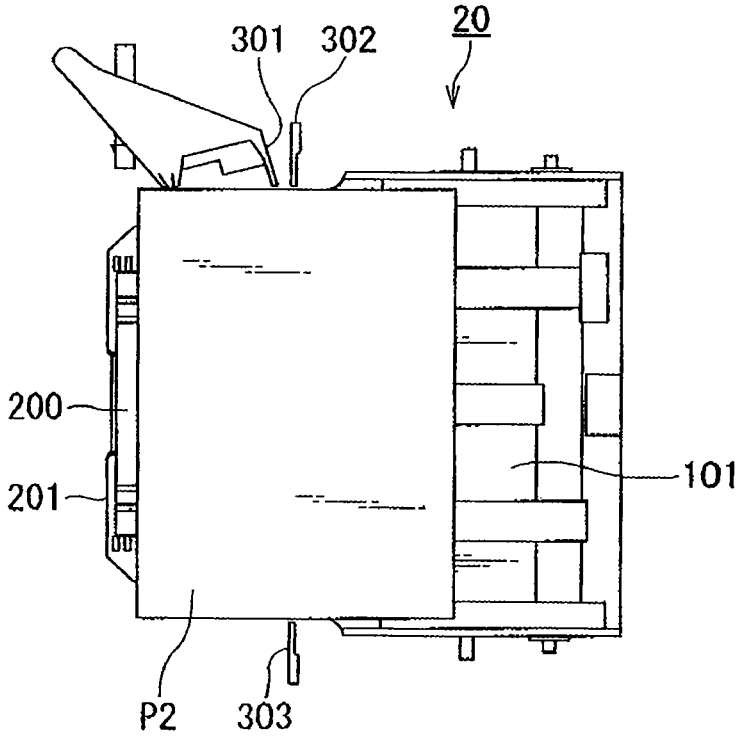

Thereafter, as shown in FIG. 20 and FIG. 21, the conveyance tray 201 on which the second sheet bundle P2 is stacked is moved toward the sheet feed tray 101.

When the conveyance tray 201 moves to a position (first position) where it completely overlaps the sheet feed tray 101, the sheet rear end guide 200 presses the end of the second sheet bundle P2 in the longitudinal direction to the side panel 103, and the longitudinal alignment is performed.

Figure 22:
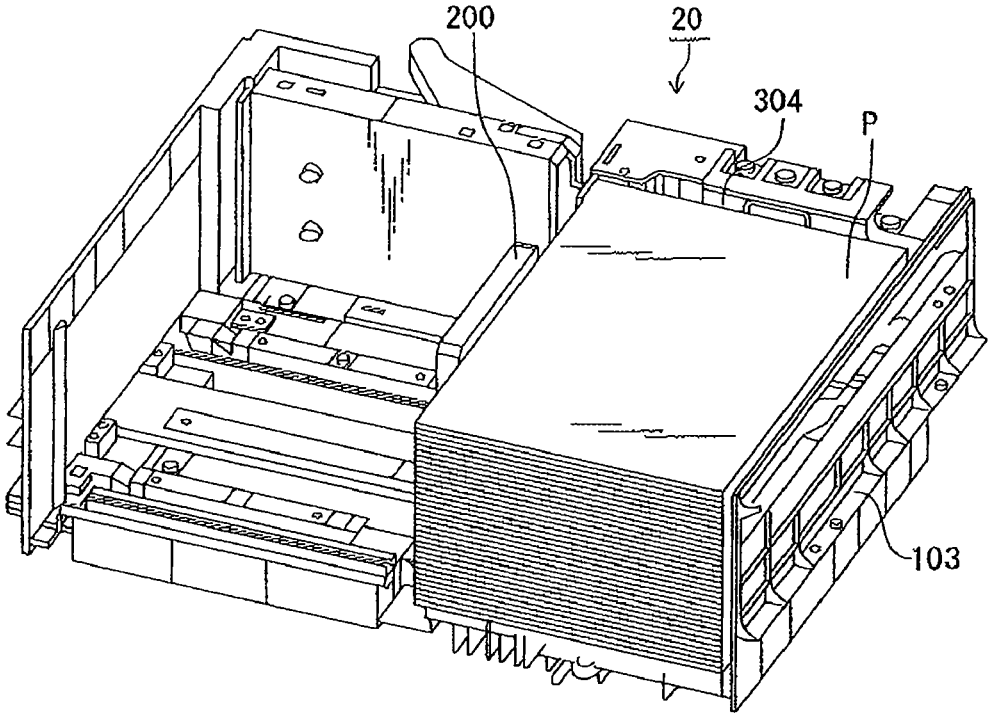
FIG. 22 and FIG. 23 are a fifth perspective view and a fifth plan view showing the movement of the sheet bundle in the sheet feeder, respectively.
Figure 23:
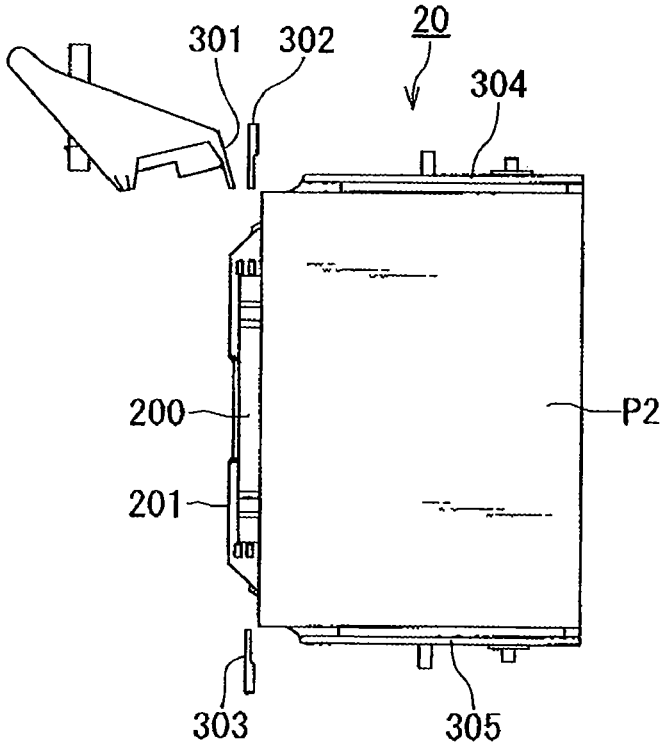

As described above, although the lateral alignment of the second sheet bundle P2 may be performed when the conveyance tray 201 is at the second position, it may be performed after the conveyance tray 201 is moved to the first position. Arrows shown in FIG. 22 and FIG. 23 show movements when the lateral alignment is performed at the first position. When the lateral alignment is performed at the first position, the conveyance tray 201 presses the end of the second sheet bundle P2 in the lateral direction to the rear side plate 304. Further, the end of the second sheet bundle P2 at the opposite side may be pressed by the front side plate 305 in the direction toward the rear side plate 304.

Figure 24:
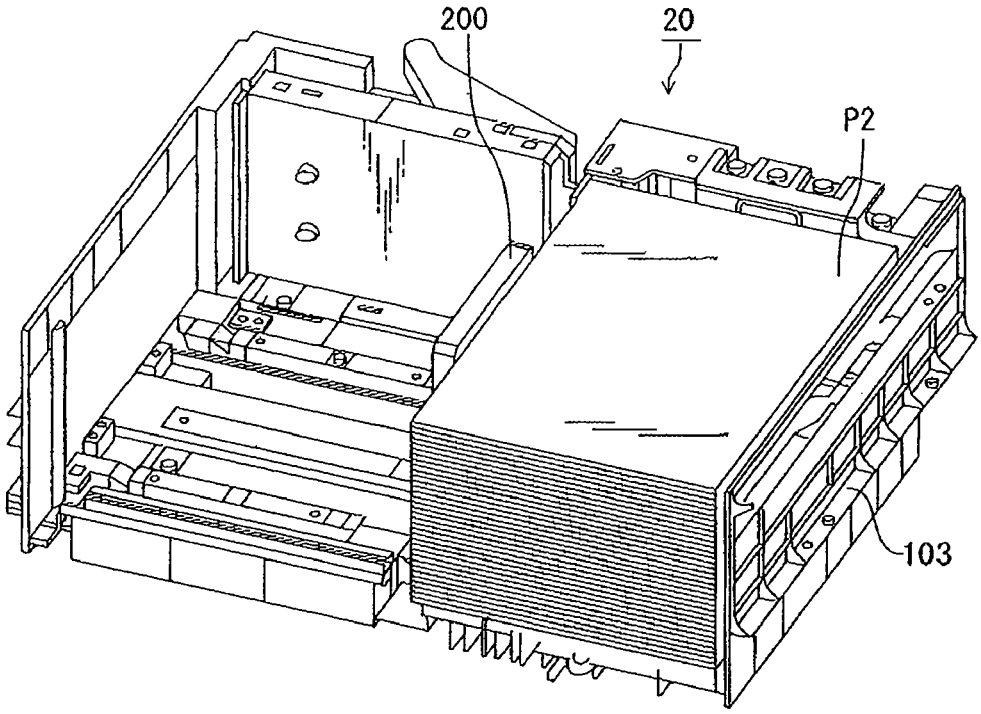
FIG. 24 and FIG. 25 are a sixth perspective view and a sixth plan view showing the movement of the sheet bundle in the sheet feeder, respectively.
Figure 25:
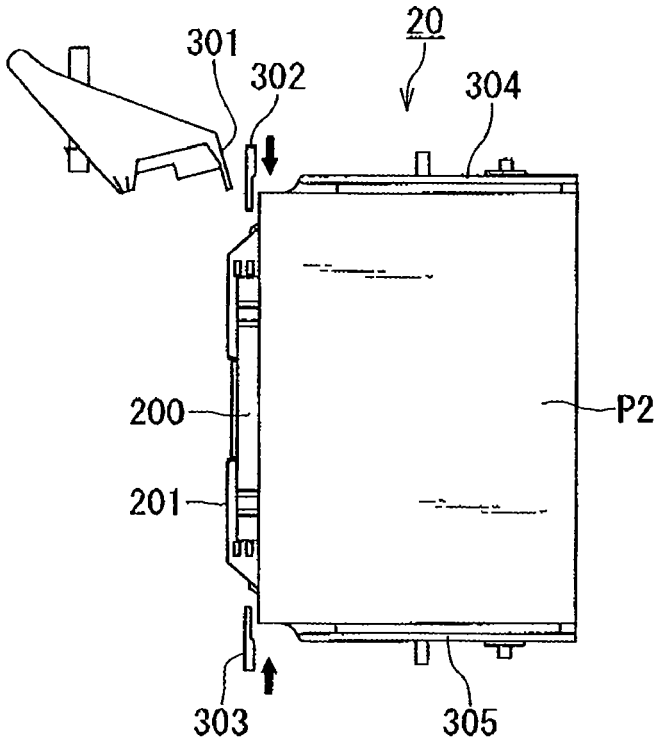

When the longitudinal alignment and the lateral alignment are ended at the first position, the stoppers 302 and 303 are moved to the closed positions, as shown in FIG. 24 and FIG. 25.

For the case in which the lateral alignment is performed at the second position, only the longitudinal alignment is performed at the first position, and accordingly, immediately after the longitudinal alignment is ended, the stoppers 302 and 303 are moved to the closed positions.

Figure 26:
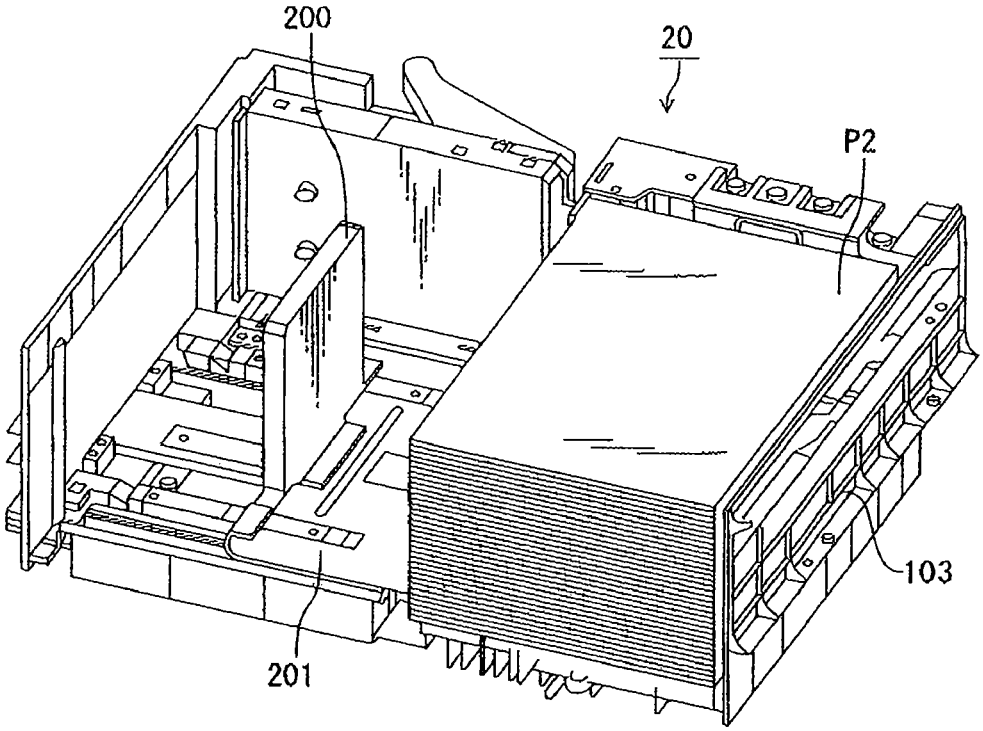
FIG. 26 and FIG. 27 are a seventh perspective view and a seventh plan view showing the movement of the sheet bundle in the sheet feeder, respectively.
Figure 27:
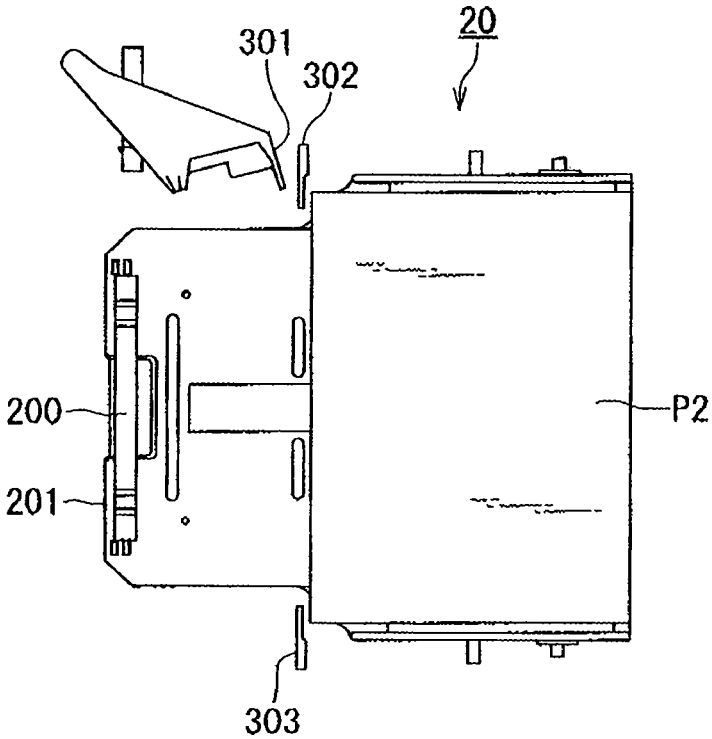

Thereafter, as shown in FIG. 26 and FIG. 27, the conveyance tray 201 is moved toward the second position. At this time, since the movement of the second sheet bundle P2 is restrained by the stoppers 302 and 303, the second sheet bundle P2 is left on the sheet feed tray 101.

Figure 28:
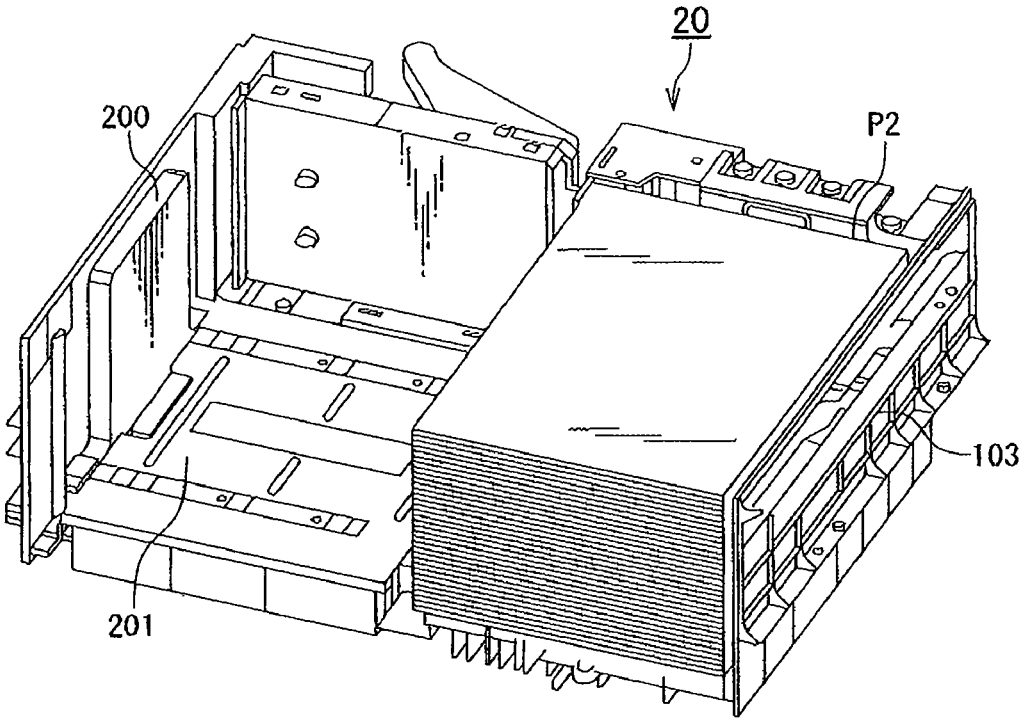
FIG. 28 and FIG. 29 are an eighth perspective view and an eighth plan view showing the movement of the sheet bundle in the sheet feeder, respectively.
Figure 29:
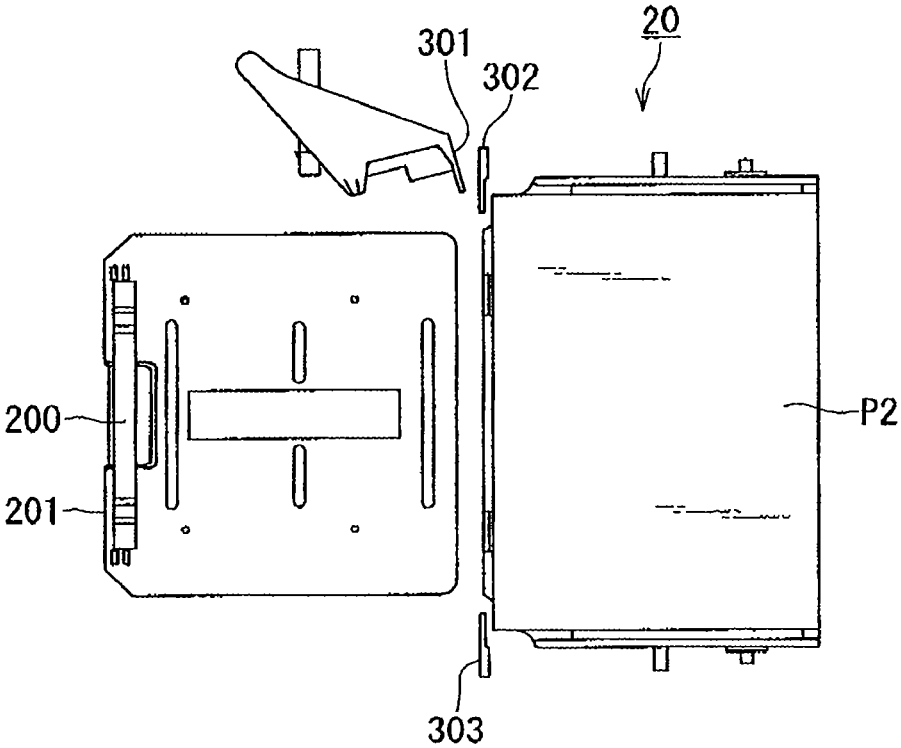

Finally, as shown in FIG. 28 and FIG. 29, the conveyance tray 201 is returned to the second position finally in an empty state.

While the second sheet bundle P2 left on the sheet feed tray 101 is placed in a state where sheet feeding can be performed by the pickup roller 300 (see FIG. 6), the conveyance tray 201 can be pulled out from the image forming apparatus 1 independently of the sheet feed tray 101. Thus, even when the second sheet bundle P2 is being fed from the sheet feed tray 101, the empty conveyance tray 201 is pulled out and a different sheet bundle can be supplied. When the different sheet bundle is stacked on the conveyance tray 201 and the conveyance tray is pushed in, the state of FIG. 10 and FIG. 11 occurs, and hereinafter, the operation from FIGS. 10 and 11 to FIGS. 28 and 29 is repeated.

As described above, according to the tandem LCF 20 (sheet feeder) of the embodiment, the image forming apparatus 1 having the same and the method for sheet feeding, both the longitudinal alignment and the lateral alignment of the stacked sheet bundle can be well performed, and a large amount of sheets can be continuously fed.

The invention is not limited to the above embodiment, and at the practical stage, the components can be modified and embodied within the scope not departing from the gist. Besides, various embodiments of the invention can be formed by suitable combinations of the plural components disclosed in the embodiment. For example, some components may be deleted from all components described in the embodiment. Further, components of different embodiments may be suitably combined.

What is claimed is:

1. A sheet feeder comprising:

a sheet feed tray on which a first sheet bundle is stacked at a first position where sheet feeding to a conveyance path can be performed;

a conveyance tray on which a second sheet bundle is stacked at a second position adjacent to the sheet feed tray, and which conveys the second sheet bundle to the sheet feed tray and stacks the second sheet bundle on the sheet feed tray after the first sheet bundle is fed, presses an end of the second sheet bundle in a direction perpendicular to a conveyance direction of the conveyance tray to a first side plate after the second sheet bundle is stacked on the sheet feed tray, the first side plate being provided at a side position of the sheet feed tray, and aligns the end of the second sheet bundle; and a second side plate that is disposed at a side position of the sheet feed tray opposite to the first side plate, can be moved in the direction perpendicular to the conveyance direction, and presses an end opposite to the end of the second sheet bundle toward the first side plate when the conveyance tray presses the end of the second sheet bundle to the first side plate.

2. The feeder according to claim 1, further comprising a stopper that extends to a rear end side of the second sheet bundle after the conveyance tray stacks the second sheet bundle on the sheet feed tray and before the conveyance tray returns to the second position, and prevents the second sheet bundle stacked on the sheet feed tray from moving in a direction toward the second position.

3. A sheet feeder comprising:

a sheet feed tray on which a first sheet bundle is stacked at a first position where sheet feeding to a conveyance path can be performed;

a conveyance tray on which a second sheet bundle is stacked at a second position adjacent to the sheet feed tray, and which conveys the second sheet bundle to the sheet feed tray and stacks the second sheet bundle on the sheet feed tray after the first sheet bundle is fed, presses an end of the second sheet bundle in a direction perpendicular to a conveyance direction of the conveyance tray to a first side plate, the first side plate being provided at a side position of the conveyance tray when the conveyance tray is at the second position, and aligns the end of the second sheet bundle; and a second side plate that is disposed at a side position of the conveyance tray opposite to the first side plate can be moved in the direction perpendicular to the conveyance direction, and presses an end opposite to the end of the second sheet bundle toward the first side plate when the conveyance tray presses the end of the second sheet bundle to the first side plate.

4. An image forming apparatus comprising:

a scanner to read an original document and to generate image data;

an image forming section to print the image data on a sheet;

a sheet feed tray on which a first sheet bundle is stacked at a first position where sheet feeding to a conveyance path can be performed;

a conveyance tray on which a second sheet bundle is stacked at a second position adjacent to the sheet feed tray, and which conveys the second sheet bundle to the sheet feed tray and stacks the second sheet bundle on the sheet feed tray after the first sheet bundle is fed, presses an end of the second sheet bundle in a direction perpendicular to a conveyance direction of the conveyance tray to a first side plate after the second sheet bundle is stacked on the sheet feed tray, the first side plate being provided at a side position of the sheet feed tray, and aligns the end of the second sheet bundle; and a second side plate that is disposed at a side position of the sheet feed tray opposite to the first side plate, can be moved in the direction perpendicular to the conveyance direction, and presses an end opposite to the end of the second sheet bundle toward the first side plate when the conveyance tray presses the end of the second sheet bundle to the first side plate.

5. The apparatus according to claim 4, further comprising a stopper that extends to a rear end side of the second sheet bundle after the conveyance tray stacks the second sheet bundle on the sheet feed tray and before the conveyance tray returns to the second position, and prevents the second sheet bundle stacked on the sheet feed tray from moving in a direction toward the second position.

6. An image forming apparatus comprising:

a scanner to read an original document and to generate image data;

an image forming section to print the image data on a sheet;

a sheet feed tray on which a first sheet bundle is stacked at a first position where sheet feeding to a conveyance path can be performed;

a conveyance tray on which a second sheet bundle is stacked at a second position adjacent to the sheet feed tray, and which conveys the second sheet bundle to the sheet feed tray and stacks the second sheet bundle on the sheet feed tray after the first sheet bundle is fed, presses an end of the second sheet bundle in a direction perpendicular to a conveyance direction of the conveyance tray to a first side plate, the first side plate being provided at a side position of the conveyance tray when the conveyance tray is at the second position, and aligns the end of the second sheet bundle; and a second side plate that is disposed at a side position of the conveyance tray opposite to the first side plate, can be moved in the direction perpendicular to the conveyance direction, and presses an end opposite to the end of the second sheet bundle toward the first side plate when the conveyance tray presses the end of the second sheet bundle to the first side plate.

7. A method of sheet feeding, comprising:

stacking a first sheet bundle on a sheet feed tray disposed at a first position to feed a sheet to a conveyance path;

stacking a second sheet bundle on a conveyance tray at a second position adjacent to the sheet feed tray;

conveying the second sheet bundle to the sheet feed tray and stacking it on the sheet feed tray after the first sheet bundle is fed;

pressing the second sheet bundle, by the conveyance tray after the second sheet bundle is stacked on the sheet feed tray, in a direction perpendicular to a conveyance direction of the conveyance tray to a first side plate provided at a side position of the sheet feed tray to align an end of the second sheet bundle; and pressing an end opposite to the end of the second sheet bundle, by a second side plate, toward the first side plate when the conveyance tray presses the end of the second sheet bundle to the first side plate, the second side plate being disposed at a side position of the sheet feed tray opposite to the first side plate, and movable in the direction perpendicular to the conveyance direction.

8. The method according to claim 7, wherein a stopper extends to a rear end side of the second sheet bundle after the conveyance tray stacks the second sheet bundle on the sheet feed tray and before the conveyance tray returns to the second position, and prevents the second sheet bundle stacked on the sheet feed tray from moving in a direction toward the second position.

9. A method of sheet feeding, comprising:

stacking a first sheet bundle on a sheet feed tray disposed at a first position to feed a sheet to a conveyance path;

stacking a second sheet bundle on a conveyance tray at a second position adjacent to the sheet feed tray;

conveying the second sheet bundle to the sheet feed tray and stacking it on the sheet feed tray after the first sheet bundle is fed;

pressing the second sheet bundle, by the conveyance tray when the conveyance tray is at the second position, in a direction perpendicular to a conveyance direction of the conveyance tray to a first side plate provided at a side position of the conveyance tray to align an end of the second sheet bundle; and pressing an end opposite to the end of the second sheet bundle, by a second side plate, toward the first side plate when the conveyance tray presses the end of the second sheet bundle to the first side plate, the second side plate being disposed at a side position of the conveyance tray opposite to the first side plate, and movable in the direction perpendicular to the conveyance direction.

* * * * *